US007706714B2

(12) United States Patent
Kamimura

(10) Patent No.: US 7,706,714 B2
(45) Date of Patent: Apr. 27, 2010

(54) IMAGE-FORMING DEVICE AND DEVELOPER CARTRIDGE HAVING LEAKAGE RESTRAINING MEMBER AND DEVELOPER MOVING MEMBER

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 662 days.

(21) Appl. No.: 11/527,569

(22) Filed: Sep. 27, 2006

(65) Prior Publication Data

US 2007/0071488 A1 Mar. 29, 2007

(30) Foreign Application Priority Data

Sep. 27, 2005 (JP) ..... 2005-280228

(51) Int. Cl.
*G03G 15/08* (2006.01)

(52) U.S. Cl. ..... 399/103; 399/99; 399/102; 399/119

(58) Field of Classification Search ..... 399/98, 399/99, 101, 102, 103, 119, 303
See application file for complete search history.

(56) References Cited

U.S. PATENT DOCUMENTS 6,356,723 B1 3/2002 Sato et al.
6,496,669 B2 * 12/2002 Sato et al. ..... 399/103
6,553,195 B2 * 4/2003 Korfhage et al. ..... 399/102
6,708,011 B2 3/2004 Nomura et al.

FOREIGN PATENT DOCUMENTS

JP 2001-60040 3/2001
JP 2003-15378 1/2003

* cited by examiner

*Primary Examiner*—David P Porta
*Assistant Examiner*—Benjamin Schmitt
(74) *Attorney, Agent, or Firm*—Banner & Witcoff, LTD

(57) ABSTRACT

An image-forming device includes a plurality of developer cartridges, a developer moving member and a conveying belt. Each of the developer cartridges includes a casing, a developing roller and a leakage restraining member. The peripheral surface of the developer cartridge has a first peripheral part to convey the developer accommodated in the casing and a second peripheral part. The leakage restraining member is disposed between the casing and the second peripheral part and slidingly contacts the second peripheral part so as to restrain the developer from leaking out of the first peripheral part. The developer moving member moves developer leaked from between the second peripheral part and the leakage restraining member out of a predetermined region at a position opposing the leakage restraining member.

20 Claims, 12 Drawing Sheets

IMAGE-FORMING DEVICE AND DEVELOPER CARTRIDGE HAVING LEAKAGE RESTRAINING MEMBER AND DEVELOPER MOVING MEMBER

CROSS REFERENCE TO RELATED APPLICATIONS

This application claims priorities to Japanese Patent Application Nos. 2005-280228 filed on Sep. 27, 2005, the contents of which are hereby incorporated by reference into the present application.

TECHNICAL FIELD

One aspect of the invention relates to an image-forming device such as a laser printer, and a developer cartridge provided in the image-forming device.

BACKGROUND

Image-forming devices such as laser printers include tandem color image-forming devices that are well known in the art, such as that disclosed in Japanese unexamined patent application publication No. 2003-015378. These types of image-forming devices have a plurality of detachably mounted developer cartridges for supplying developer to the surfaces of respective photosensitive drums.

The developer cartridge generally includes a casing for accommodating developer, and a developing roller rotatably supported in the casing for carrying developer supplied within the casing. An elongated opening is formed in the casing so that a portion of the surface of the developing roller is exposed therethrough and opposes the surface of the photosensitive drum. The developing roller carries developer from the casing on the surface thereof. As the developing roller rotates, the developer carried on the surface of the developing roller comes into contact with the surface of the photosensitive drum and is supplied to the electrostatic latent image formed on the surface of the photosensitive drum. The developer develops the electrostatic latent image into a developer image, and the developer image is subsequently transferred onto a sheet of paper, thereby forming an image on the paper.

In this type of developer cartridge, a side seal is provided on both ends of the developing roller in order to prevent developer from leaking between the ends of the developing roller and the casing.

Japanese unexamined patent application publication No. 2001-60040 proposes fixing a safeguard film formed of PET film on the lower front edge of the casing in the developer cartridge at the front part of the side seals. With this construction, even if developer leaks from the developer cartridge, the safeguard film can minimize the damage caused by such leakage.

SUMMARY

However, in the developer cartridge disclosed in Japanese unexamined patent application publication No. 2001-60040, developer that cannot be stopped by the safeguard drops onto the conveying belt in the image-forming device after exceeding a prescribed amount. The developer falls onto the conveying belt at a position corresponding to the side seals. A color image-forming device having a plurality of developer cartridges will convey the fallen developer to developer cartridges positioned downstream, at which time the fallen developer will be positioned opposite side seals of the neighboring developer cartridges. In such a case, the fallen developer may enter the side seals of the adjacent developer cartridge via the respective photosensitive drum, contributing to the decline of those side seals. Consequently, developer may begin to leak from the neighboring developer cartridges, generating a chain reaction of developer leaking from the plurality of developer cartridges.

In view of the above-described drawbacks, it is one aspect of the present invention to provide a developer cartridge capable of reliably preventing a chain reaction of developer leakage in neighboring developer cartridges by ensuring that leaked developer falls onto the conveying belt at positions not corresponding to the side seals. It is another aspect of the present invention to provide an image-forming device equipped with the developer cartridge.

To achieve the above and other objects, one aspect of the present invention may provide an image-forming device including a plurality of developer cartridges, a developer moving member and a conveying belt. Each of the developer cartridges includes a casing, a developing roller and a leakage restraining member. The casing accommodates developer therein and has an opening. The developing roller is rotatably provided in the opening, and has a rotational shaft and a peripheral surface. A plurality of rotational shafts of the plurality of developer cartridges is arranged in parallel with one another. The peripheral surface has a first peripheral part to convey the developer accommodated in the casing and a second peripheral part. The leakage restraining member is disposed between the casing and the second peripheral part and slidingly contacts the second peripheral part so as to restrain the developer from leaking out of the first peripheral part. The developer moving member moves developer leaked from between the second peripheral part and the leakage restraining member out of a predetermined region at a position opposing the leakage restraining member. The conveying belt is disposed below the plurality of developer cartridges to convey an image formed by developer supplied from the developing roller in a direction orthogonal to the rotational shaft.

To achieve the above and other objects, another aspect of the present invention may provide a developer cartridge detachable from an image-forming device including a conveying belt disposed below the developer cartridge to convey an image in a conveying direction when the developer cartridge is mounted on the image-forming device. The developer cartridge includes a casing, a developing roller, a leakage restraining member and a developer moving member. The casing accommodates developer therein and has an opening. The developing roller is rotatably provided in the opening, and has a rotational shaft and a peripheral surface. The peripheral surface has a first peripheral part to convey the developer accommodated in the casing and a second peripheral part. The leakage restraining member is disposed between the casing and the second peripheral part and slidingly contacts the second peripheral part so as to restrain the developer from leaking out of the first peripheral part. The developer moving member moves developer leaked from between the second peripheral part and the leakage restraining member out of a predetermined region at a position opposing the leakage restraining member.

BRIEF DESCRIPTION OF THE DRAWINGS

One aspect of the invention may be more readily described with reference to the accompanying drawings.

DETAILED DESCRIPTION

Figure 1:
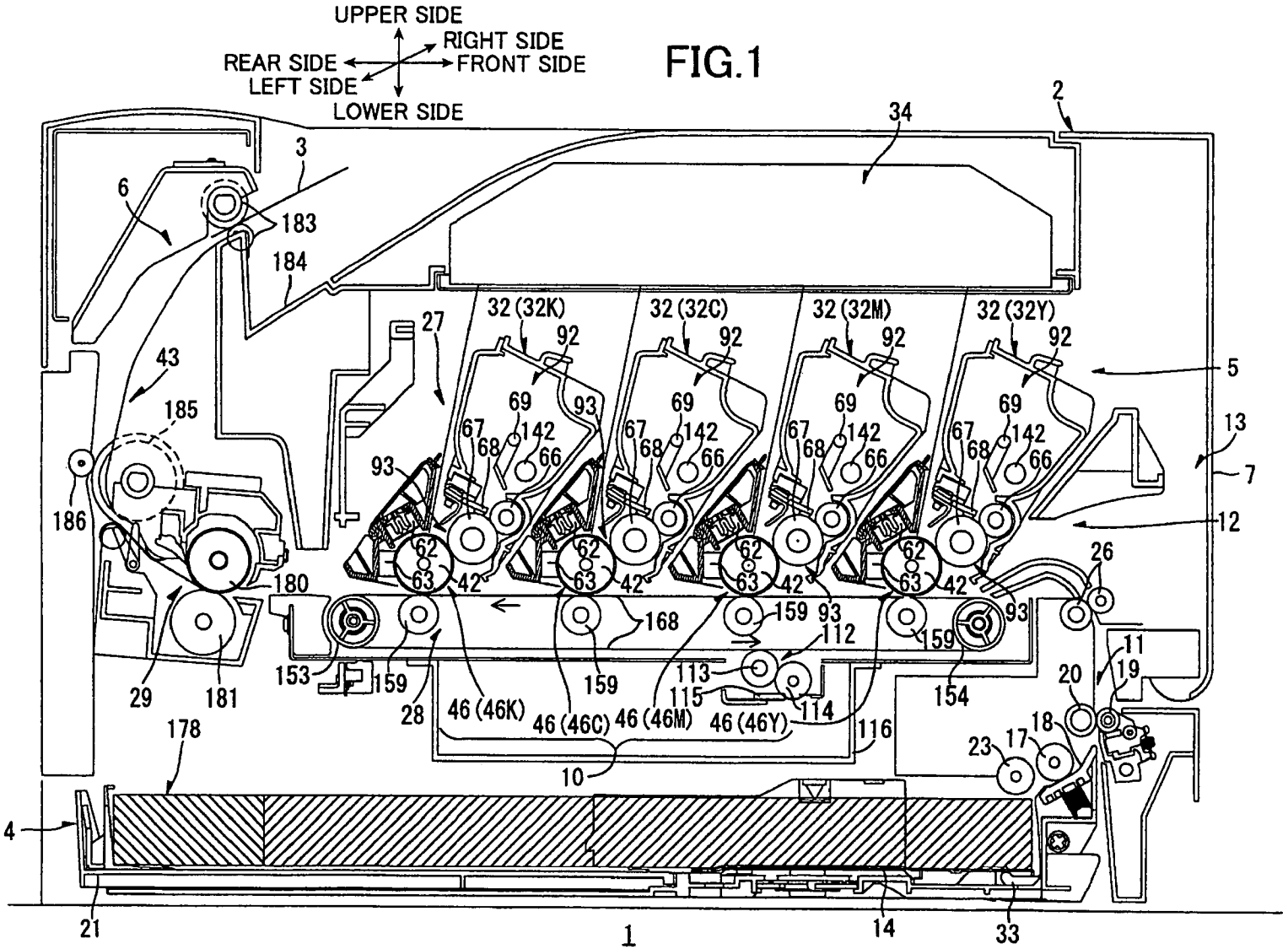
FIG. 1 is a side cross-sectional view of a color laser printer according to at least one aspect of the invention.

An image-forming device and a cartridge according to preferred embodiments of aspects of the present invention will be described while referring to the accompanying drawings wherein like parts and components are designated by the same reference numerals to avoid duplicating description.

1. General Structure of a Color Laser Printer

Figure 2:
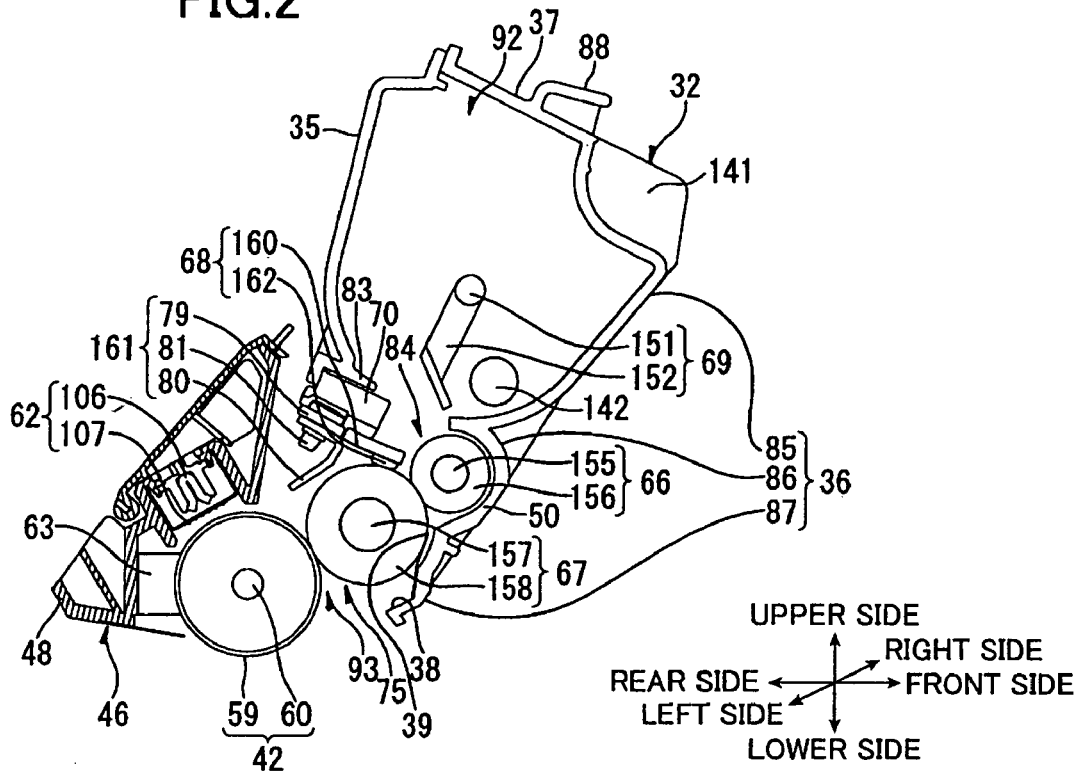
FIG. 2 is a side cross-sectional view of a drum subunit for the color laser printer in FIG. 1 having a developer cartridge mounted therein.
Figure 3:
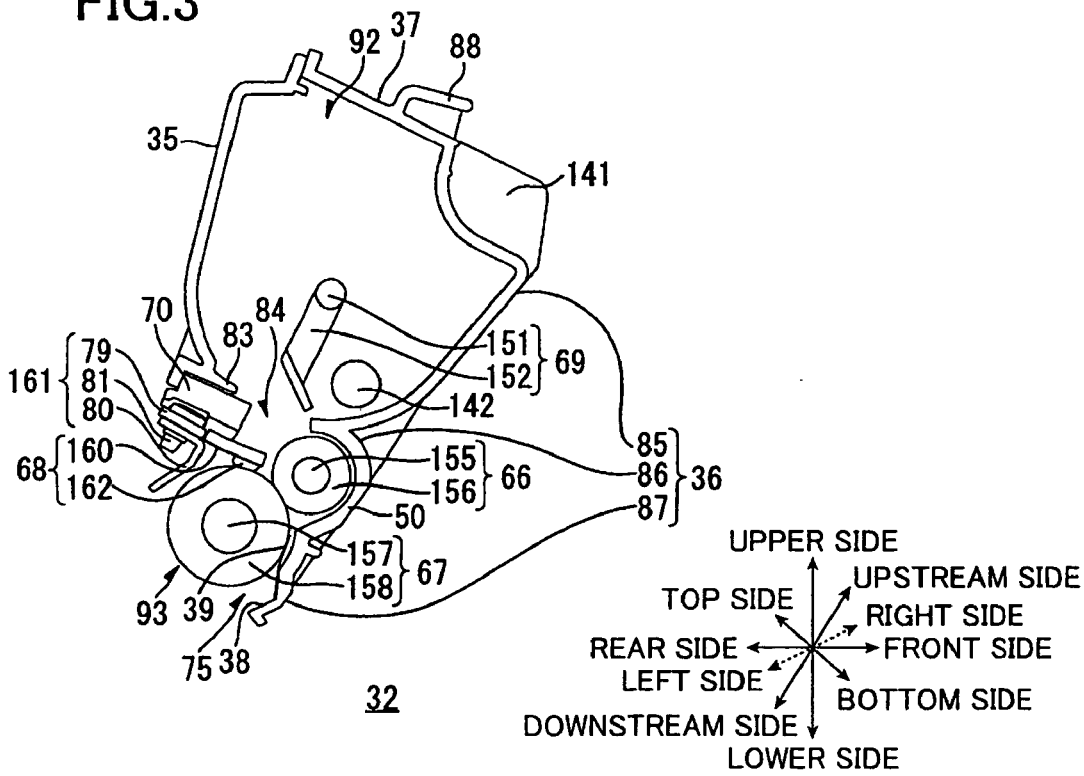
FIG. 3 is a side cross-sectional view of the developer cartridge in FIG. 2.
Figure 4:
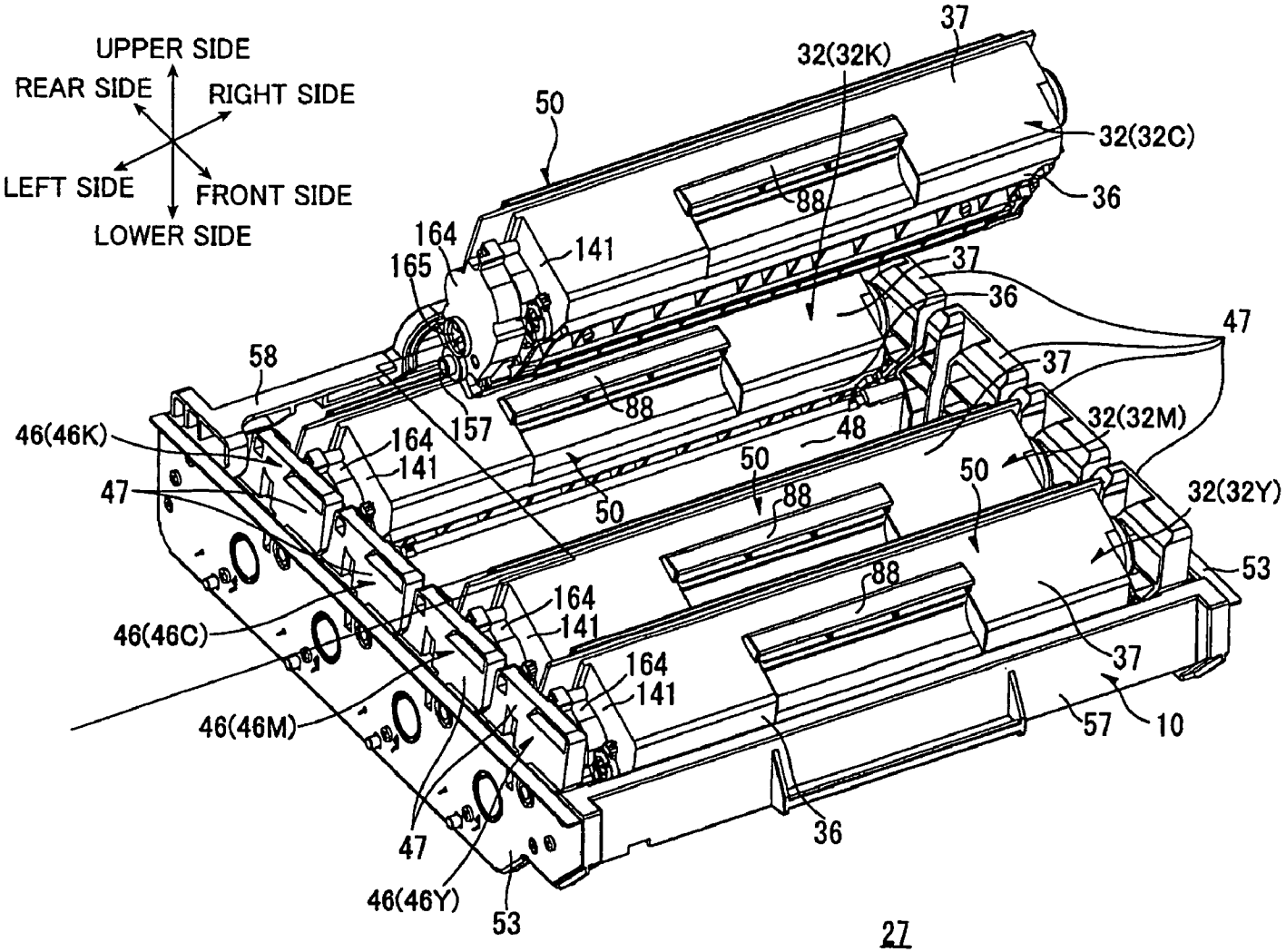
FIG. 4 is a left side perspective view of a process unit.

FIG. 1 is a side cross-sectional view showing a color laser printer, serving as a preferred embodiment of the image-forming device according to the present invention. FIG. 2 is a side cross-sectional view of a drum subunit provided in the color laser printer of FIG. 1 on which a developer cartridge is mounted. FIG. 3 is a side cross-sectional view of the developer cartridge shown in FIG. 2. FIG. 4 is a left side perspective view of a process unit provided in the color laser printer of FIG. 1.

As shown in FIG. 1, a color laser printer 1 is a horizontal tandem-type printer having a plurality of drum subunits 46 juxtaposed in a horizontal direction. The color laser printer 1 includes a main casing 2 and, within the main casing 2, a feeding unit 4 for supplying sheets of a paper 3, an image-forming unit 5 for forming images on the paper 3 supplied from the feeding unit 4, and a discharge unit 6 for discharging the paper 3 after an image has been formed thereon.

In the following description, the right side of the printer 1 (side of the main casing 2 in which a drum access opening 13 is formed) will be referred to as the "front side," while the left side of the printer 1 will be referred to as the "rear side." Further, the near side in FIG. 1 with respect to the paper thickness direction will be referred to as the "left side," while the far side in FIG. 1 will be referred to as the "right side."

Unless otherwise stated below, directions in the following description of a drum unit 10 and developer cartridges 32 will conform to the state in which the drum unit 10 and developer cartridges 32 are mounted in the main casing 2.

(1) Main Casing

The main casing 2 is formed substantially in a rectangular box shape that is open on the front side. A process unit accommodating section 12 is formed inside the main casing 2 for accommodating a process unit 27 described later. A front cover 7 is provided on the front side of the main casing 2. The front cover 7 is rotatably supported via hinges (not shown) provided on the lower end on the front wall of the main casing 2 so as to be capable of opening and closing on the main casing 2. When the front cover 7 is closed about the hinges, the front cover 7 covers the process unit accommodating section 12. When the front cover 7 is opened about the hinges, the process unit accommodating section 12 is exposed, enabling the user to mount the process unit 27 into the process unit accommodating section 12 or remove the process unit 27 from the process unit accommodating section 12 from the front of the main casing 2.

A tray accommodating section 178 is also formed in the main casing 2 below the process unit accommodating section 12 for accommodating a paper tray 21 described later. The paper tray 21 is slidably mounted into the tray accommodating section 178 in a front-to-rear direction.

(2) Feeding Unit

The feeding unit 4 includes the tray accommodating section 178 provided in the lower section of the main casing 2, the paper tray 21 for accommodating the paper 3 that can be slid into the tray accommodating section 178 in a front-to-rear direction from the front side of the main casing 2, a separating roller 17 and a separating pad 18 disposed in confrontation with each other at a position above the front end of the paper tray 21, and a feeding roller 23 disposed on the rear side of the separating roller 17.

The feeding unit 4 includes a feeding-end paper-conveying path 11 for guiding the paper 3 conveyed from the paper tray 21. The feeding-end paper-conveying path 11 is substantially U-shaped in a side view for initially guiding the paper 3 forward and subsequently reversing directions toward the rear. The feeding-end paper-conveying path 11 has an upstream end positioned on the lower side of the U-shape adjacent to the separating roller 17, and a downstream end positioned on the upper side of the U-shape adjacent to a conveying belt 168 described later.

The feeding unit 4 also includes a paper dust roller 19 and a pinch roller 20 disposed in confrontation with each other along the feeding-end paper-conveying path 11 and positioned above and forward of the separating roller 17; and a pair of registration rollers 26 also disposed on the feeding-end paper-conveying path 11 above the paper dust roller 19 and pinch roller 20.

A paper-pressing plate 14 is provided inside the paper tray 21 for supporting the paper 3 in a stacked state. The paper-pressing plate 14 is pivotably supported on the rear end thereof, so that the front end can pivot downward to a resting position in which the paper-pressing plate 14 rests on a bottom plate of the paper tray 21 and can pivot upward to a feeding position in which the paper-pressing plate 14 slopes upward from the rear end to the front end.

A feeding lever 33 is provided in the lower front section of the paper tray 21 for lifting the front end of the paper-pressing plate 14 upward. The feeding lever 33 is pivotably supported at a position below the front end of the paper-pressing plate 14 so that the front end of the feeding lever 33 can move up and down.

By pivoting the feeding lever 33, the feeding lever 33 lifts the front end of the paper-pressing plate 14, shifting the paper-pressing plate 14 into the feeding position. When the paper-pressing plate 14 is in the feeding position, the topmost sheet of paper 3 stacked on the paper-pressing plate 14 is pressed against the feeding roller 23. When the feeding roller 23 rotates, the paper 3 is fed toward a position between the separating roller 17 and separating pad 18.

When the paper tray 21 is removed from the main casing 2, the paper-pressing plate 14 settles into the resting position. While the paper-pressing plate 14 is in the resting positions, sheets of the paper 3 can be stacked on the paper-pressing plate 14.

After the feeding roller 23 has fed the paper 3 to a position between the separating roller 17 and separating pad 18, the rotating separating roller 17 separates and conveys the paper 3 one sheet at a time. The sheet conveyed by the separating roller 17 passes between the paper dust roller 19 and pinch roller 20, at which time the paper dust roller 19 removes paper dust from the paper 3, and continues along the feeding-end paper-conveying path 11 toward the registration rollers 26. After registering the paper 3, the registration rollers 26 convey the paper 3 to the conveying belt 168.

(3) Image-forming Unit

The image-forming unit 5 includes a scanning unit 34, the process unit 27, a transfer unit 28, and a fixing unit 29.

(3-1) Scanning Unit

A single scanning unit 34 is disposed in the top section of the main casing 2. Although not shown in the drawings, the scanning unit 34 includes a laser light-emitting unit, a polygon mirror, and a plurality of lenses and reflecting mirrors. The laser light-emitting unit emits laser beams based on image data for each color. The laser beams are scanned by the polygon mirror, pass through or are reflected by the plurality of lenses and reflecting mirrors, and are irradiated onto respective photosensitive drums 42 corresponding to each color.

(3-2) Process Unit

The process unit 27 is disposed below the scanning unit 34 and above the feeding unit 4. As shown in FIG. 4, the process unit 27 includes a single drum unit 10, and four developer cartridges 32 corresponding to the four colors that are juxtaposed in the front-to-rear direction.

(3-2-1) Drum Unit

As shown in FIG. 1, the drum unit 10 is detachably mounted in the process unit accommodating section 12 of the main casing 2 from the front side of the main casing 2 in a front-to-rear direction. The drum unit 10 includes four drum subunits 46 for each of the four colors. Specifically, the four drum subunits 46 are a yellow drum subunit 46Y, a magenta drum subunit 46M, a cyan drum subunit 46C, and a black drum subunit 46K.

The drum subunits 46 are disposed parallel to each other at intervals in the front-to-rear direction. Specifically, the drum subunits 46 are arranged from the front side to the rear side in the order yellow drum subunit 46Y, magenta drum subunit 46M, cyan drum subunit 46C, and black drum subunit 46K. Further, each drum subunit 46 includes a pair of side frame sections 47 (see FIG. 4) positioned across a gap from each other in a width direction (the left-to-right direction orthogonal to the front-to-rear direction and the vertical direction), and a center frame section 48 (see FIG. 2) spanning between rear ends of the side frame sections 47.

The drum unit 10 is assembled by arranging the drum subunits 46 parallel to each other in the front-to-rear direction, as described above; arranging a front beam 57 (see FIG. 4) in front of the frontmost drum subunit 46; arranging a rear beam 58 (see FIG. 4) to the rear of the rearmost drum subunit 46; and interposing the front beam 57, drum subunits 46, and rear beam 58 in the width direction with a pair of side plates 53.

As shown in FIG. 2, each drum subunit 46 holds the photosensitive drum 42, a Scorotron charger 62, and a cleaning brush 63.

The photosensitive drum 42 is positioned so as to extend in the width direction. The photosensitive drum 42 includes a main drum body 59 that is cylindrical in shape and that has a positive charging photosensitive layer formed of polycarbonate or the like on its outer surface; and a drum shaft 60 disposed along the axis of the main drum body 59.

Both widthwise ends of the drum shaft 60 are supported in the side frame sections 47 of the respective drum subunit 46 so as to be incapable of rotating relative to the side frame sections 47.

Rotational support members (not shown) are fitted onto both axial ends of the main drum body 59 so as to be incapable of rotating relative to the same, but capable of rotating relative to the drum shaft 60. With this structure, the main drum body 59 is rotatably supported on the drum shaft 60. During an image-forming process, the photosensitive drum 42 is rotated by a driving force transmitted from a motor (not shown) provided in the main casing 2.

The charger 62 is supported on the center frame section 48 of the drum subunit 46 diagonally above and rearward of the photosensitive drum 42 so as to oppose the photosensitive drum 42 at a distance. The charger 62 includes a discharge wire 106 disposed in opposition to but separated from the photosensitive drum 42, and a grid 107 provided between the discharge wire 106 and the photosensitive drum 42.

During an image-forming operation, a high-voltage circuit board (not shown) provided in the main casing 2 applies a high-voltage to the discharge wire 106 in the charger 62 to produce a corona discharge from the discharge wire 106. At the same time, a high-voltage circuit board (not shown) provided in the main casing 2 applies a grid bias to the grid 107 to apply a uniform positive charge to the surface of the photosensitive drum 42 while controlling the amount of charge supplied thereto.

The cleaning brush 63 is supported on the center frame section 48 at a position rearward of the photosensitive drum 42 and opposes and is in contact with the photosensitive drum 42. During an image-forming operation, a high-voltage circuit board (not shown) provided in the main casing 2 applies a cleaning bias to the cleaning brush 63.

(3-2-2) Developer Cartridge

As shown in FIG. 4, the developer cartridges 32 are detachably mounted in correspondence to the drum subunits 46 for each color. Specifically, the developer cartridges 32 include a yellow developer cartridge 32Y detachably mounted in the yellow drum subunit 46Y, a magenta developer cartridge 32M detachably mounted in the magenta drum subunit 46M, a cyan developer cartridge 32C detachably mounted in the cyan drum subunit 46C, and a black developer cartridge 32K detachably mounted in the black drum subunit 46K.

As shown in FIG. 3, each developer cartridge 32 includes a casing 50 and, within the casing 50, an agitator 69, a supply roller 66, a developing roller 67, and a thickness-regulating blade 68.

The casing 50 is formed in a box shape having an opening 75 on the lower end. A partitioning wall 83 is provided midway in the casing 50 with respect to the vertical for partitioning the interior of the casing 50 into a toner-accommodating chamber 92 and a developing chamber 93. A through-hole 84 is formed in the partitioning wall 83 to allow communication between the toner-accommodating chamber 92 and developing chamber 93.

As shown in FIG. 4, a passive coupling gear 165 and a gear mechanism (not shown) are provided on the left side surface of the casing 50. The passive coupling gear 165 receives a driving force inputted from a motor (not shown) provided in the main casing 2. The gear mechanism transmits the driving force inputted into the passive coupling gear 165 to the developing roller 67, supply roller 66, and agitator 69. A gear cover 164 is also provided on the left side surface of the casing 50 for covering the gear mechanism while exposing the left side of the passive coupling gear 165.

As shown in FIG. 3, the toner-accommodating chamber 92 is the space in the casing 50 formed above the partitioning wall 83 that functions to accommodate toner of the corresponding color. More specifically, the toner-accommodating chamber 92 of the yellow developer cartridge 32Y accommodates yellow toner, the 92 of the magenta developer cartridge 32M magenta toner, the 92 of the cyan developer cartridge 32C cyan toner, and the 92 of the black developer cartridge 32K black toner.

The toner of each color is a nonmagnetic, single-component toner having a positive charge. The polymerized toner is substantially spherical in shape and is obtained by co-polymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) metaacrylate. The base particle of the toner is formed primarily of a binding resin that is compounded with a coloring agent of the corresponding color, a charge-controlling agent, wax, and the like and further includes an additive for improving fluidity.

A coloring agent in yellow, magenta, cyan, and black is compounded with the binding resin to produce each of these colors. The charge-controlling agent is a charge-controlling resin obtained by co-polymerizing an ionic monomer having an ionic functional group, such as ammonium salt, with a monomer that can be co-polymerized with an ionic monomer, such as a styrene monomer or an acrylic monomer. The additive may be powder of a metal oxide, such as silica, aluminum oxide, titanium oxide, strontium titanate, cerium oxide, or magnesium oxide; or an inorganic powder such as a carbide powder or metal salt powder.

Windows 142 are formed in the toner-accommodating chamber 92 for detecting the amount of toner remaining in the toner-accommodating chamber 92. The windows 142 are embedded in both of a pair of sidewalls 141 forming the widthwise sides of the casing 50 and opposing each other across the toner-accommodating chamber 92.

The agitator 69 is disposed in the toner-accommodating chamber 92 and includes a rotational shaft 151 rotatably supported in both sidewalls 141 of the casing 50, and an agitating member 152 provided on the rotational shaft 151 along the axis thereof and extending radially outward from the rotational shaft 151. During image formation, a driving force from a motor (not shown) provided in the main casing 2 is transmitted to the rotational shaft 151 via the passive coupling gear 165, causing the agitating member 152 to move circularly within the toner-accommodating chamber 92.

The developing chamber 93 occupies the space in the casing 50 below the partitioning wall 83. The supply roller 66 is disposed inside the developing chamber 93 below the through-hole 84. The supply roller 66 includes a supply roller shaft 155 formed of metal that is rotatably supported in both sidewalls 141 of the casing 50, and a sponge roller 156 formed of an electrically conductive sponge material covering the periphery of the supply roller shaft 155. During image formation, a driving force from a motor (not shown) provided in the main casing 2 is transmitted to the supply roller shaft 155 via the passive coupling gear 165 to drive the supply roller 66 to rotate.

The developing roller 67 is disposed inside the developing chamber 93 diagonally below and rearward of the supply roller 66. The developing roller 67 includes a developing roller shaft 157 formed of metal and rotatably supported in both sidewalls 141 of the casing 50, and a rubber roller 158 formed of an electrically conductive rubber that covers the periphery of the developing roller shaft 157.

More specifically, the rubber roller 158 has a two-layer structure including a rubber roller layer configured of an electrically conductive urethane rubber, silicon rubber, or EPDM rubber, or the like containing fine carbon particles and the like; and a coating applied to the surface of the rubber roller layer and formed primarily of urethane rubber, urethane resin, polyimide resin, or the like.

The developing roller 67 is disposed against the supply roller 66 so as to generate pressure between the rubber roller 158 and sponge roller 156. The developing roller 67 is also exposed in the bottom of the developing chamber 93 through the opening 75.

During image formation, a driving force from a motor (not shown) provided in the main casing 2 is transmitted to the developing roller shaft 157 via the passive coupling gear 165 for rotating the developing roller 67. A developing bias supplied from a high-voltage circuit board (not shown) provided in the main casing 2 is also applied to the developing roller 67.

The thickness-regulating blade 68 is disposed in the developing chamber 93 so as to press against the developing roller 67 from above. The thickness-regulating blade 68 includes a blade 160 configured of a metal leaf spring member, and a pressing part 162 provided on a distal end of the blade 160. The pressing part 162 is formed of an insulating silicon rubber and has a semicircular cross-section.

A base end of the blade 160 is fixed to the partitioning wall 83 by a fixing member 161. The elastic force of the blade 160 causes the pressing part 162 on the distal end to contact the rubber roller 158 of the developing roller 67 from above with pressure.

(3-2-3) Developing Operation in the Process Unit

In each developer cartridge 32, toner of the corresponding color accommodated in the toner-accommodating chamber 92 shifts toward the through-hole 84 by its own weight. As the agitator 69 agitates the toner, some of the toner is discharged through the through-hole 84 into the developing chamber 93.

Toner discharged through the through-hole 84 into the developing chamber 93 is supplied onto the supply roller 66. As the supply roller 66 rotates, the toner carried on the supply roller 66 is supplied to the developing roller 67. At this time, the toner is positively tribocharged between the supply roller 66 and the developing roller 67 as a developing bias is applied to the developing roller 67.

As the developing roller 67 rotates, toner supplied to the surface of the developing roller 67 passes between the pressing part 162 of the thickness-regulating blade 68 and the rubber roller 158 of the developing roller 67, thereby maintaining a thin layer of uniform thickness on the surface of the rubber roller 158.

In the meantime, as shown in FIG. 2, the charger 62 in the drum subunit 46 corresponding to the developer cartridge 32 generates a corona discharge for charging the surface of the photosensitive drum 42 with a uniform positive polarity. As the photosensitive drum 42 continues to rotate, a laser beam emitted from the scanning unit 34 is scanned at a high speed over the positively charged surface of the photosensitive drum 42, forming an electrostatic latent image on the photosensitive drum 42 corresponding to an image that will be formed on the paper 3.

Next, positively charged toner carried on the surface of the developing roller 67 comes into contact with the photosensitive drum 42 as the developing roller 67 rotates and is supplied to areas on the surface of the positively charged photosensitive drum 42 that were exposed to the laser beam and, therefore, have a lower potential. In this way, the latent image on the photosensitive drum 42 is developed into a visible image according to a reverse development process so that the photosensitive drum 42 carries a toner image corresponding to the relevant color.

Toner remaining on the photosensitive drum 42 after the transfer operation is recovered by the developing roller 67. Further, paper dust deposited on the photosensitive drum 42 from the paper 3 is removed by the cleaning brush 63.

(3-3) Transfer Unit

As shown in FIG. 1, the transfer unit 28 is disposed in the main casing 2 above the feeding unit 4 and extends in the front-to-rear direction beneath the process unit 27. The transfer unit 28 includes a drive roller 153, a follow roller 154, the conveying belt 168, transfer rollers 159, and a cleaning unit 112.

The drive roller 153 and follow roller 154 are disposed in opposition to each other across a distance in the front-to-rear direction. The drive roller 153 is disposed rearward of the black drum subunit 46K, while the follow roller 154 is disposed forward of the yellow drum subunit 46Y.

The conveying belt 168 is an endless belt formed of a synthetic resin film such as an electrically conductive polycarbonate or polyimide containing dispersed conductive particles such as carbon. The conveying belt 168 is looped around the drive roller 153 and follow roller 154. The circulating direction of the conveying belt 168, that is the direction in which the conveying belt 168 conveys the paper 3, is a counterclockwise direction indicated in FIG. 1 and is orthogonal to the width direction of the developer cartridge 32 and drum subunit 46 in a plan view.

During image formation, a driving force from a motor (not shown) provided in the main casing 2 is transferred to the drive roller 153 for rotating the same. Specifically, when the drive roller 153 is driven to rotate, the conveying belt 168 travels in a circuit around the drive roller 153 and follow roller 154, while the follow roller 154 follows the movement of the conveying belt 168. The conveying belt 168 moves in the same direction as the surfaces of the photosensitive drums 42 at transfer positions in which the conveying belt 168 contacts the photosensitive drums 42.

The transfer rollers 159 are disposed inside the conveying belt 168 at positions opposing each of the photosensitive drums 42 with the conveying belt 168 interposed therebetween. Each of the transfer rollers 159 is configured of a metal roller shaft covered with a rubber roller that is formed of an electrically conductive rubber. The transfer roller 159 is rotatably provided so that the surface of the transfer roller 159 moves in the same direction as the conveying belt 168 at the transfer position. During image formation, a high-voltage circuit board (not shown) provided in the main casing 2 applies a transfer bias to the transfer rollers 159.

The cleaning unit 112 is disposed below the conveying belt 168 and includes a primary cleaning roller 113, a secondary cleaning roller 114, a scraping blade 115, and a toner collector 116.

The primary cleaning roller 113 is disposed so as to contact the lower portion of the conveying belt 168 on the side opposite the upper portion of the conveying belt 168 that contacts the photosensitive drums 42 and transfer rollers 159. The primary cleaning roller 113 is configured to rotate in a direction that follows the circular movement of the conveying belt 168 at the point of contact. During image formation, a high-voltage circuit board (not shown) provided in the main casing 2 applies a primary cleaning bias to the primary cleaning roller 113.

The secondary cleaning roller 114 is disposed below the primary cleaning roller 113 and in contact with the same and is configured to rotate so that the peripheral surface of the secondary cleaning roller 114 moves in the same direction as the primary cleaning roller 113 at the contact position. During image formation, a high-voltage circuit board (not shown) provided in the main casing 2 applies a secondary cleaning bias to the secondary cleaning roller 114.

The scraping blade 115 is disposed at a position in contact with the secondary cleaning roller 114 from below. The toner collector 116 is disposed below the primary cleaning roller 113 and secondary cleaning roller 114 for collecting toner that falls from the secondary cleaning roller 114.

The conveying belt 168 moving circuitously along with the driving of the drive roller 153 and the following of the follow roller 154 conveys a sheet of paper 3 supplied from the feeding unit 4 toward the rear of the printer 1 so that the paper 3 sequentially passes transfer positions corresponding to each drum subunit 46. As the paper 3 is conveyed, toner images in each color carried on the photosensitive drum 42 of each drum subunit 46 are sequentially transferred onto the paper 3, forming a color image thereon.

For example, first a yellow toner image carried on the surface of the photosensitive drum 42 in the yellow drum subunit 46Y is transferred onto the paper 3, after which a magenta toner image carried on the surface of the photosensitive drum 42 in the magenta drum subunit 46M is transferred onto the paper 3 and superimposed over the yellow toner image already transferred. In the same way, a cyan toner image and a black toner image carried on the surfaces of the photosensitive drums 42 in the cyan drum subunit 46C and black drum subunit 46K, respectively, are superimposed over the previously transferred toner images to form a color image on the paper 3.

Any toner deposited on the surface of the conveying belt 168 in the transfer operation described above is subsequently cleaned by the cleaning unit 112. First, the toner on the surface of the conveying belt 168 is transferred to the primary cleaning roller 113 by a primary cleaning bias and is subsequently transferred to the secondary cleaning roller 114 by a secondary cleaning bias. Next, the scraping blade 115 scrapes off-toner that has been transferred onto the secondary cleaning roller 114. Toner scraped off the secondary cleaning roller 114 drops into the toner collector 116.

(3-4) Fixing Unit

The fixing unit 29 is disposed in the main casing 2 rearward of the black drum subunit 46K. The fixing unit 29 is also positioned opposite, with respect to the front-to-rear direction, the transfer position in which the photosensitive drum 42 contacts the conveying belt 168. The fixing unit 29 includes a heating roller 180, and a pressure roller 181.

The heating roller 180 is configured of a metal tube, the surface of which has been coated with a release layer. The metal tube accommodates a halogen lamp extending along the axial direction of the tube for heating the surface of the heating roller 180 to a fixing temperature. The pressure roller 181 is disposed below and in confrontation with the heating roller 180. The pressure roller 181 presses against the heating roller 180 from the bottom thereof.

After a color image has been transferred onto a sheet of paper 3, the paper 3 is conveyed to the fixing unit 29. In the fixing unit 29, the color image is fixed to the paper 3 by heat as the paper 3 passes between the heating roller 180 and pressure roller 181.

(4) Discharge Unit

The discharge unit 6 has a discharge-end conveying path 43 formed therein. The discharge-end conveying path 43 is substantially U-shaped in a side view, with an upstream end positioned on the lower side adjacent to the fixing unit 29 and a downstream end positioned on the upper side adjacent to a discharge tray 184 formed on top of the main casing 2. Hence, the discharge-end conveying path 43 initially guides the paper 3 rearward, then reverses directions and discharges the paper 3 in a forward direction.

A conveying roller 185 and a pinch roller 186 are disposed in confrontation with each other along the discharge-end conveying path 43. Further, a pair of discharge rollers 183 is disposed on the downstream end of the discharge-end conveying path 43. The discharge tray 184 is formed on top of the main casing 2 as a depression that grows gradually deeper toward the rear side. The discharge tray 184 functions to support sheets of discharged paper 3 in a stacked state.

After the paper 3 passes through the fixing unit 29, the conveying roller 185 and pinch roller 186 convey the paper 3 along the discharge-end conveying path 43 toward the discharge rollers 183, and the discharge rollers 183 discharge the paper 3 onto the discharge tray 184.

2. Detailed Structure of the Developer Cartridge Casing

Figure 5A:
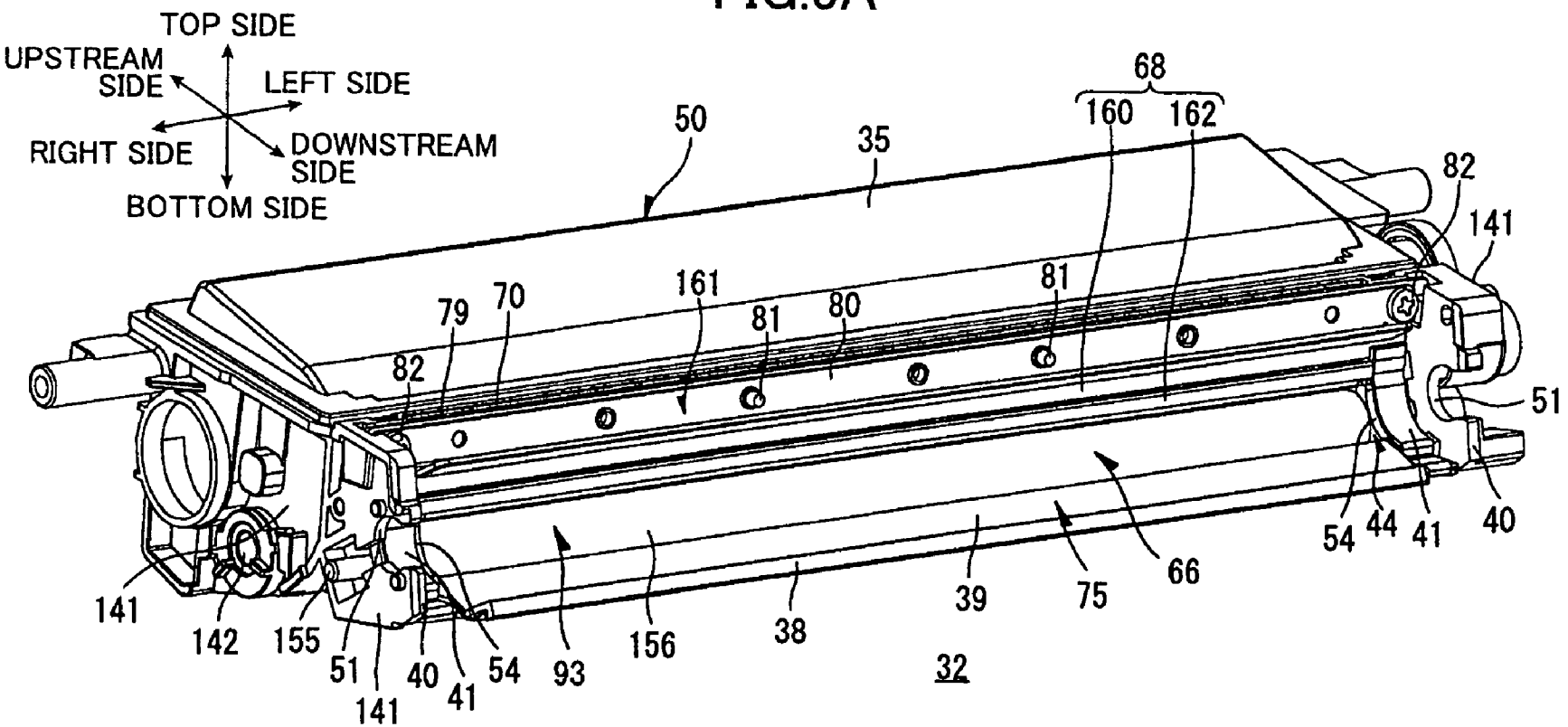
FIG. 5A is a right side perspective view of the developer cartridge when a developing roller and toner receiver are not mounted.
Figure 5B:
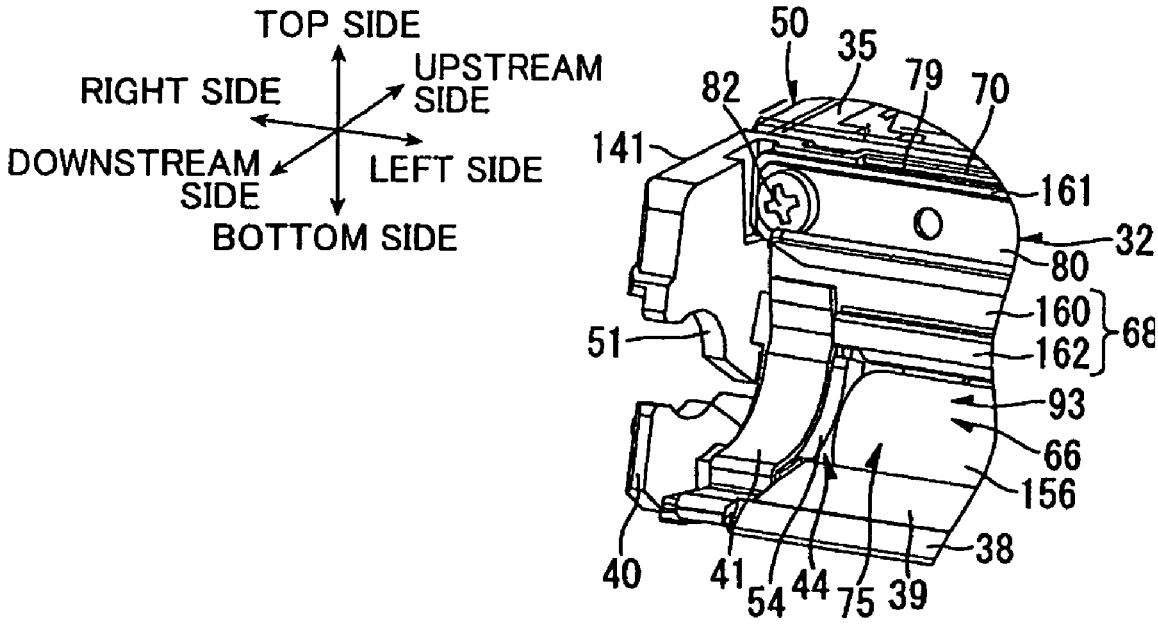
FIG. 5B is a left side perspective view showing the region around a side seal provided on the right side of the developer cartridge in FIG. 5A.
Figure 5C:
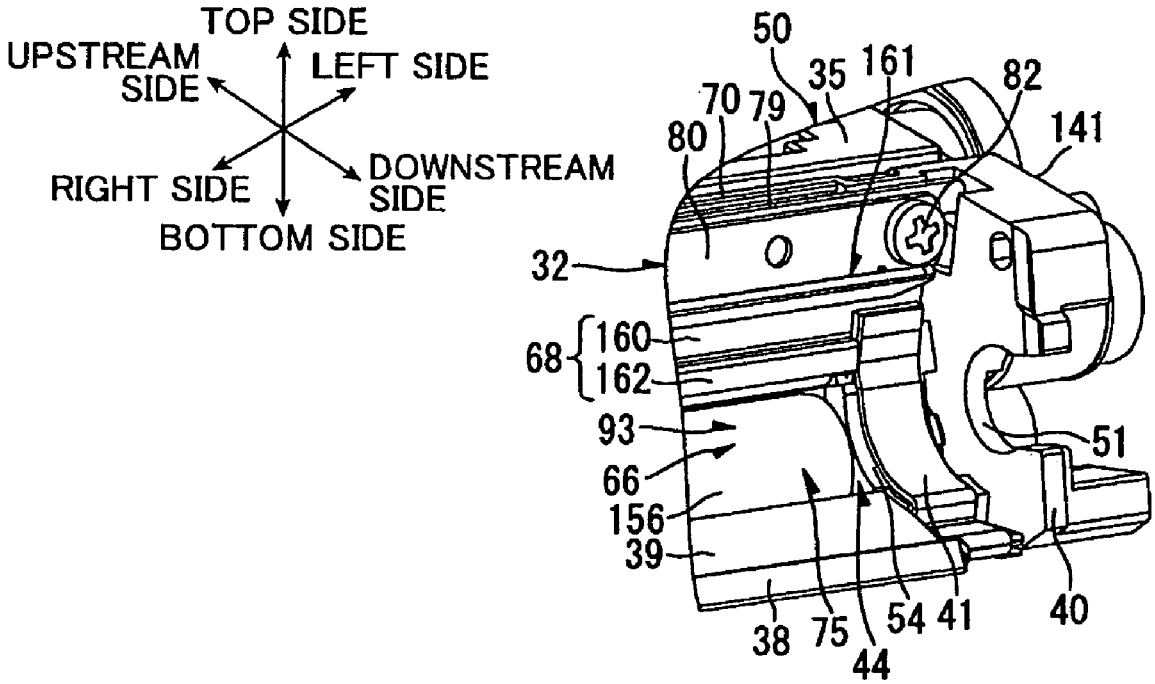
FIG. 5C is a right side perspective view illustrating the region around a side seal provided on the left side of the developer cartridge in FIG. 5A.
Figure 6:
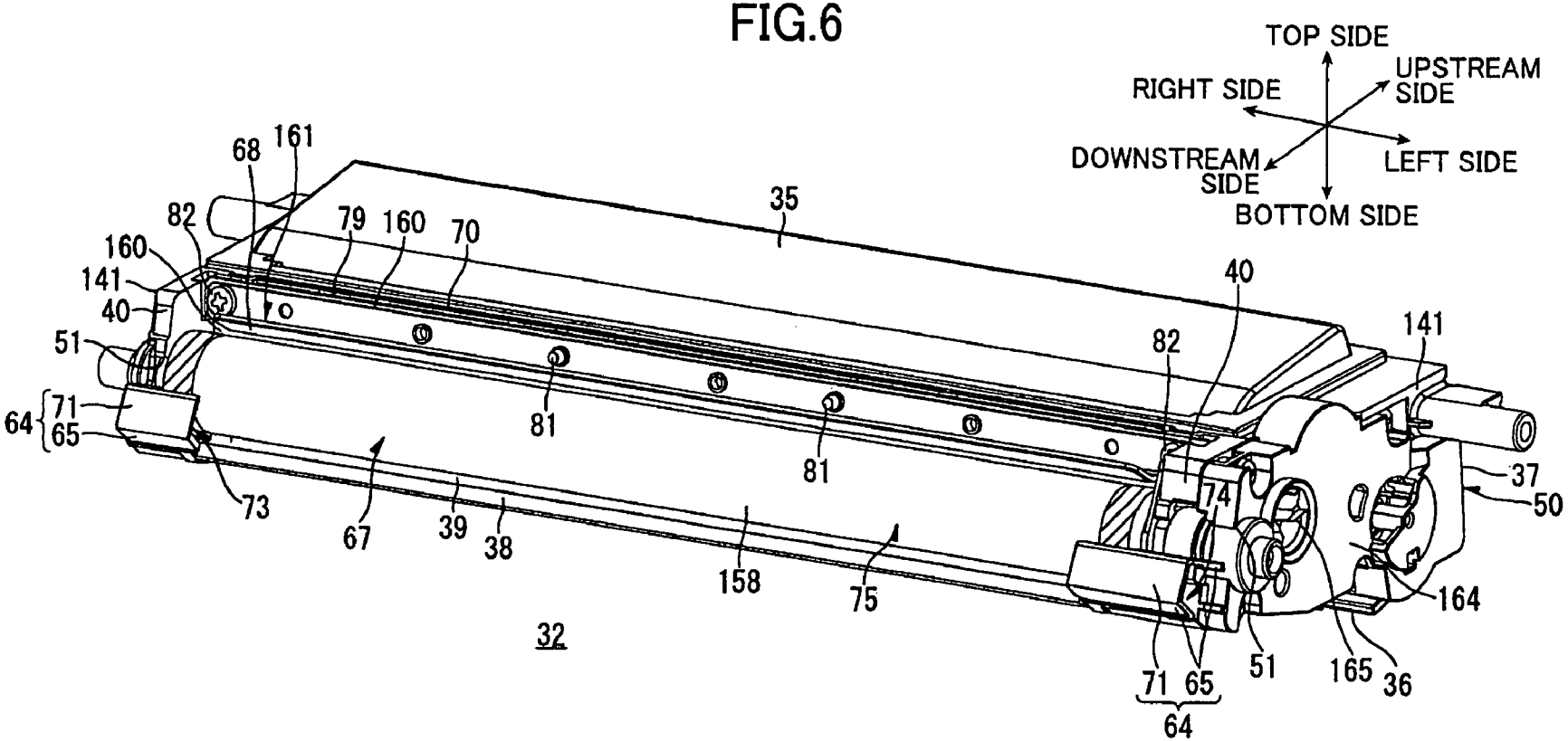
FIG. 6 is a left side perspective view showing the developer cartridge when the developing roller, the toner receiver, and a gear cover are mounted thereon.
Figure 7A:
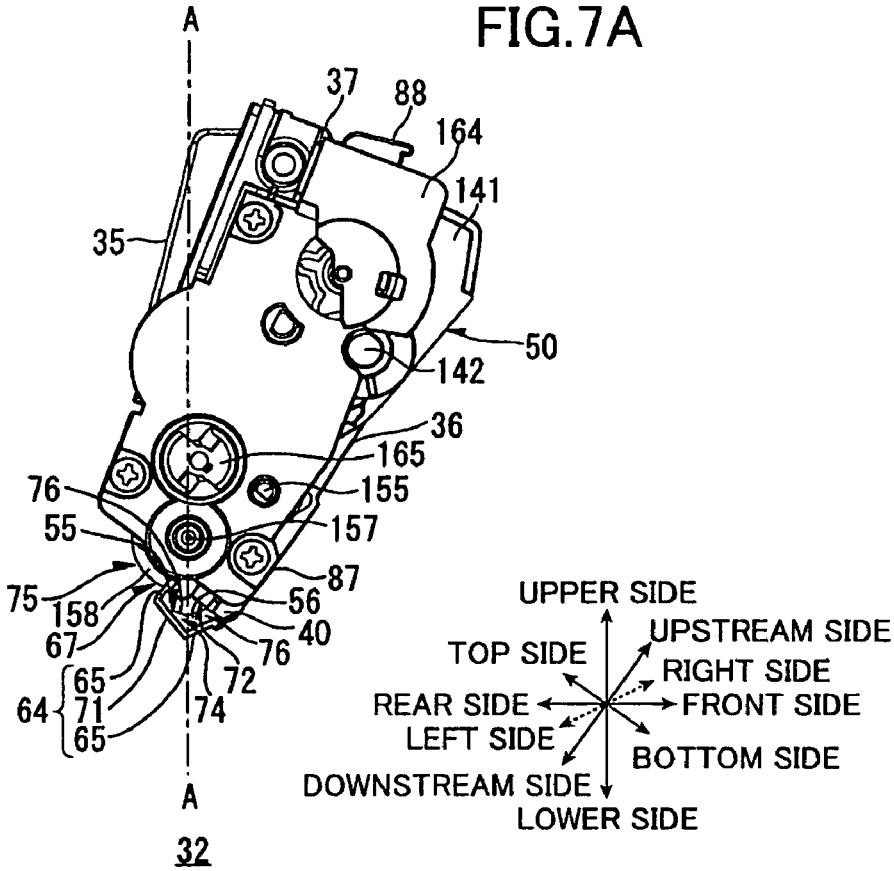
FIG. 7A is a left side view of the developer cartridge when mounted in the drum subunit.
Figure 7B:
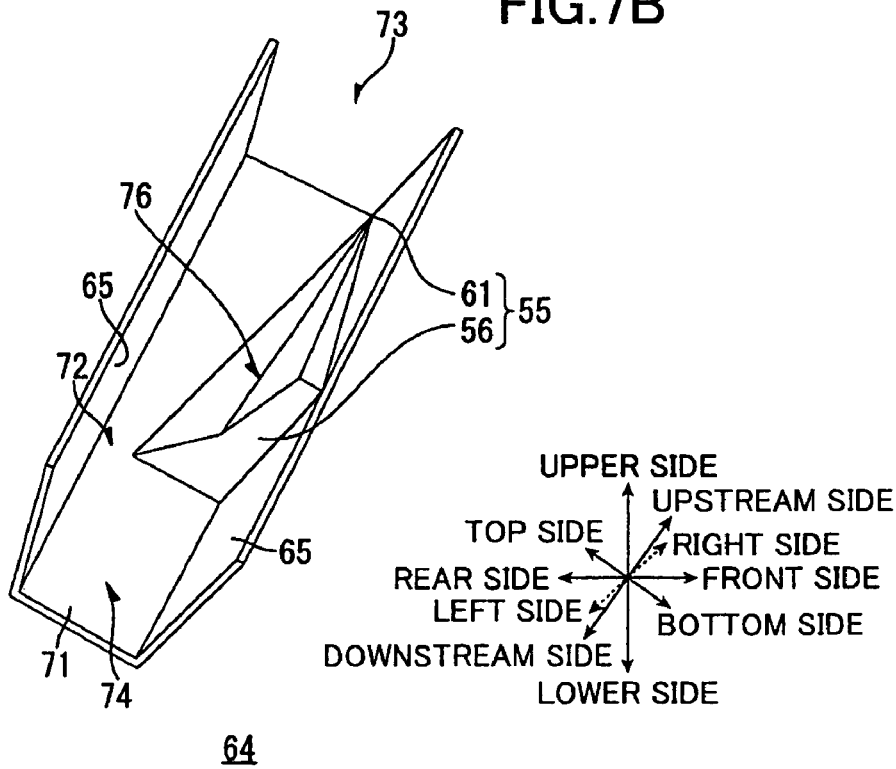
FIG. 7B is a left side perspective view of the toner receiver in FIG. 7A.
Figure 8A:
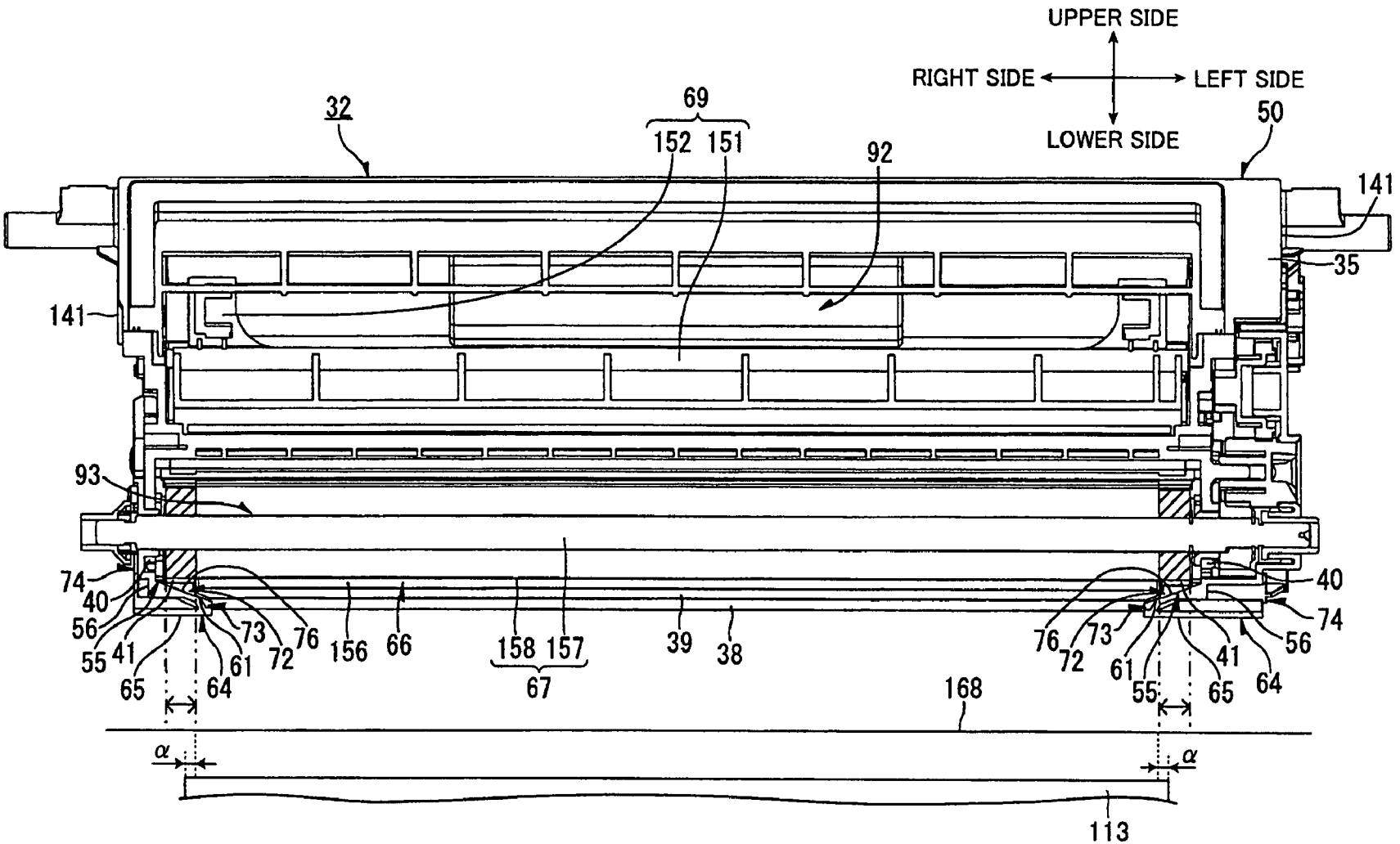
FIG. 8A is a rear cross-sectional view of the developer cartridge taken along a line A-A shown in FIG. 7A.
Figure 8B:
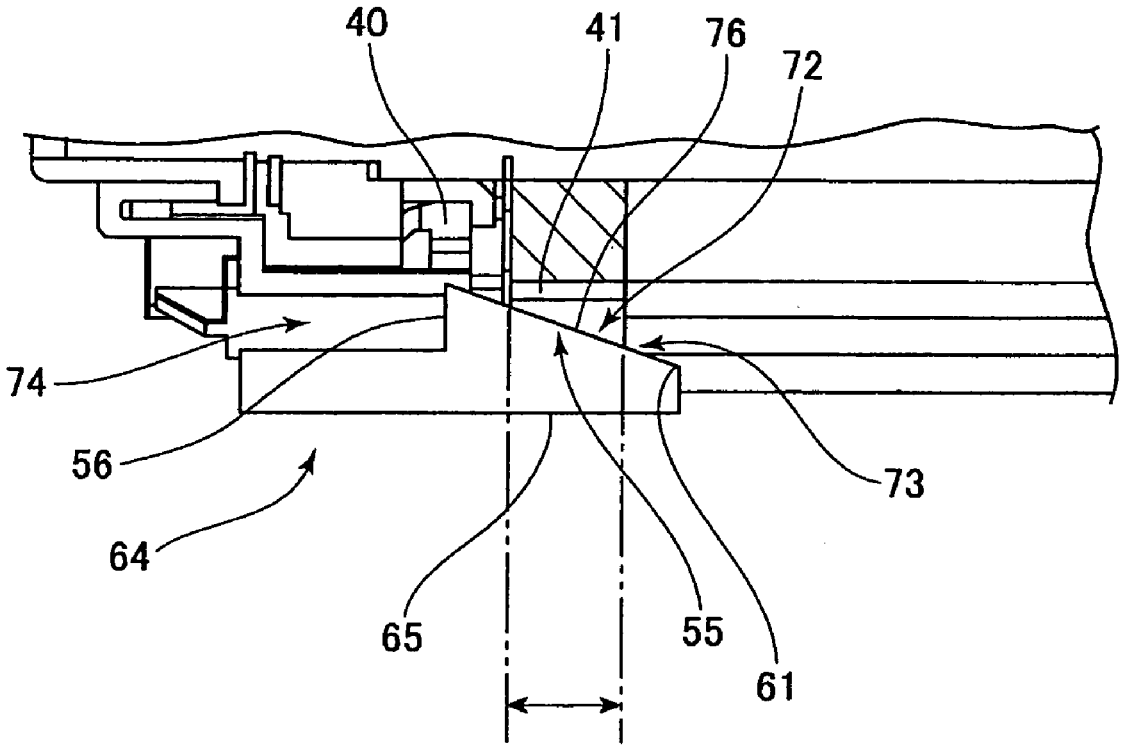
FIG. 8B is an enlarged view of the toner receiver in FIG. 8A.

FIG. 5A is a right side perspective view of the developer cartridge when a developing roller and toner receiver are not mounted. FIG. 5B is a left side perspective view showing the region around a side seal provided on the right side of the developer cartridge in FIG. 5A. FIG. 5C is a right side perspective view illustrating the region around a side seal provided on the left side of the developer cartridge in FIG. 5A. FIG. 6 is a left side perspective view showing the developer cartridge when the developing roller, the toner receiver, and a gear cover are mounted thereon. FIG. 7A is a left side view of the developer cartridge when mounted in the drum subunit. FIG. 7B is a left side perspective view of the left toner receiver in FIG. 7A. FIG. 8A is a rear cross-sectional view of the developer cartridge taken along a line A-A shown in FIG. 7A. FIG. 8B is an enlarged view of the toner receiver in FIG. 8A For convenience, the following description of the developer cartridge 32 will refer to the upper rear side shown in FIG. 3 as the "top side," and the lower front side as the "bottom side." Further, the upper front side of the developer cartridge 32 in FIG. 3 will be referred to as the "upstream side," and the lower rear side as the "downstream side." The upstream and downstream sides are defined based on the direction in which the developer cartridge 32 is mounted in the drum subunit 46.

(1) Developer-side Casing

As shown in FIG. 3, the casing 50 of the developer cartridge 32 includes a top wall 35 and a bottom wall 36 that are positioned opposite each other in the direction that the top side of the developer cartridge 32 opposes the bottom side; the pair of sidewalls 141 described above; and an upstream wall 37.

The sidewalls 141 close the space between the top wall 35 and bottom wall 36 on both widthwise sides. The top wall 35 has a flat plate-shape that is wider than the distance between the sidewalls 141 and spans between the top edges of the sidewalls 141 for sealing the top side of the toner-accommodating chamber 92 and developing chamber 93. The bottom wall 36 spans between the lower edges of the sidewalls 141 for sealing the bottom side of the toner-accommodating chamber 92 and developing chamber 93. The bottom wall 36 is integrally configured of an upstream bottom wall 85, a midstream bottom wall 86, and a downstream bottom wall 87.

The upstream bottom wall 85 has substantially a semicircular arc-shape in a side cross section and follows the rotational path of the agitator 69 in the toner-accommodating chamber 92, extending toward the upstream side to form a continuous connection with the upstream wall 37. The midstream bottom wall 86 is disposed on the downstream side of the upstream bottom wall 85 and is formed substantially in a semicircular arc-shape in a side cross section following the supply roller 66 in the developing chamber 93. The downstream bottom wall 87 is disposed on the downstream side of the midstream bottom wall 86 and is formed in a tongue-like plate shape that slopes to the bottom side in the downstream direction.

The upstream wall 37 is provided for closing the space between the top wall 35 and bottom wall 36 from the upstream side. A grip part 88 is provided on the upstream wall 37 that is gripped when the developer cartridge 32 is mounted in the drum subunit 46.

The partitioning wall 83 described above extends from the downstream end of the top wall 35 toward the bottom surface of the developer cartridge 32. The partitioning wall 83, bottom wall 36, and sidewalls 141 define the through-hole 84 described above as an elongated opening extending in the width direction.

As described above, the fixing member 161 fixes the base end of the blade 160 in the thickness-regulating blade 68 to the partitioning wall 83. More specifically, the fixing member 161 fixes the base end of the blade 160 to the downstream side surface of the partitioning wall 83, with a sealing member 70 interposed between the downstream side surface of the partitioning wall 83 and the base end of the blade 160. The sealing member 70 is disposed on the downstream side surface of the partitioning wall 83 for preventing toner from leaking between the downstream side surface and the fixing member 161.

The fixing member 161 includes a plate-shaped front support member 79, a back support member 80 that is substantially L-shaped in cross section, and an assembly screw 81. The front support member 79 is disposed on the downstream side of the sealing member 70. The base end of the blade 160 is disposed on the downstream side of the front support member 79, and the back support member 80 is disposed on the downstream side of the base end of the blade 160. The assembly screw 81 integrally fixes the back support member 80, the base end of the blade 160, and the front support member 79 together by penetrating these members in the downstream direction. The base end of the blade 160 is then fixed together with the fixing member 161 by screws 82 (see FIG. 5) to the partitioning wall 83 with the sealing member 70 interposed therebetween.

The opening 75 is defined by the back support member 80, the downstream ends of the sidewalls 141, and the downstream end of the downstream bottom wall 87 and is a substantially rectangular opening extending in the width direction.

The developing roller 67 is rotatably provided in the opening 75 and partially exposed therefrom. More specifically, the front half of the developing roller 67 is accommodated in the casing 50, while the rear half protrudes from the casing 50 through the opening 75.

A film-mounting part 38 is formed on the top side surface of the downstream bottom wall 87 and extends along the axis of the developing roller 67. A lower film 39 that is formed of polyethylene terephthalate and slids uniformly across the axial direction against the peripheral surface of the rubber roller 158 in the developing roller 67 is provided on the film-mounting part 38 for providing toner from leaking between the bottom wall 36 and the developing roller 67.

As shown in FIG. 5, each sidewall 141 includes in the opening 75 a support plate 40 for supporting each axial (widthwise) end of the developing roller shaft 157 in the developing roller 67; and a seal mounting part 44 for providing side seals 41 described later.

The support plate 40 has a plate shape extending between the top surface and bottom surface of the developer cartridge 32. A bearing hole 51 is formed in the support plate 40 for receiving the developing roller shaft 157 of the developing roller 67. The bearing hole 51 is U-shaped in a side view, with an open end on the downstream side. The bearing hole 51 receives the developing roller shaft 157 of the developing roller 67 through the open downstream end.

The seal mounting parts 44 are disposed adjacent to the respective support plates 40 on the inside thereof in the width direction (axial direction of the developing roller 67). Each seal mounting part 44 has a roller-opposing surface 54 extending in a curved shape that follows the peripheral surface of the rubber roller 158 in a side view. The roller-opposing surface 54 opposes and slidingly contacts the peripheral surface of the rubber roller 158 at the axial end thereof.

(2) Side Seals

The side seals 41 are provided on the roller-opposing surfaces 54 of the seal mounting parts 44 for preventing toner from leaking between the roller-opposing surfaces 54 and the widthwise ends of the rubber roller 158.

Each side seal 41 is a sheet-like member formed of a urethane foam or other sponge material. The side seal 41 is mounted between the top end and bottom end of the seal mounting part 44 by fitting the side seal 41 between the support plate 40 of the sidewall 141 and the widthwise inner edge of the seal mounting part 44.

The side seals 41 slidingly contact the peripheral surface of the rubber roller 158 at both widthwise ends to restrain toner from leaking between the rubber roller 158 and the roller-opposing surfaces 54. The shaded areas in FIG. 6 indicate the areas in which the side seals 41 slidingly contact the rubber roller 158.

(3) Toner Receivers

As shown in FIGS. 7, 8A and 8B, the developer cartridge 32 is provided with toner receivers 64.

The toner receivers 64 are provided at both widthwise ends of the opening 75 downstream of the developing roller 67 so that a gap is formed between the toner receivers 64 and the widthwise ends of the developing roller 67 in the mounting direction. Each toner receiver 64 is integrally configured of a pair of side walls 65, and a toner guide wall 71 that form three sides of a rectangle in a side cross section. The toner receiver 64 extends in the width direction, intersecting the corresponding support plate 40, and opposes substantially the lower half of the rubber roller 158. Note that though a space formed in the side wall 65 is illustrated in FIG. 8A, the space is omitted in FIG. 8*b*

Each side wall 65 has substantially a rectangular plate shape that extends in the width direction. The side walls 65 are spaced apart in the direction that the top side opposes the bottom side. The side wall 65 on the bottom side is supported on the downstream end of the downstream bottom wall 87 and extends downstream from the downstream edge of the downstream bottom wall 87 while sloping toward the top surface side. The side wall 65 on the top side extends parallel to the side wall 65 on the bottom side.

The toner guide wall 71 has substantially a rectangular plate shape and extends in the width direction, spanning between the downstream edges of the side walls 65. The toner guide wall 71 extends in the top-to-bottom direction between the side walls 65. The inner portion of the toner guide wall 71 with respect to the width direction, together with the inner portions of the side walls 65, is disposed in opposition to the sliding region in which the side seal 41 slides over the rubber roller 158, as indicated in FIG. 6.

The pair of side walls 65 and the toner guide wall 71 form in each toner receiver 64 a toner receiving opening 72 open on the upstream side, an inner guide opening 73 open on the inner widthwise side, and an outer guide opening 74 open on the outer widthwise side. The toner receiving opening 72 is positioned on the inner widthwise side of the region in which the side seal 41 slidingly contacts the rubber roller 158.

When the developer cartridge 32 is mounted in the drum subunit 46, as shown in FIG. 7A, the toner receiver 64 is oriented so that the connecting parts of the toner guide wall 71 and side walls 65 are at the bottommost position.

Each drum subunit 46 also has a sloped part 55 formed on the inside surfaces of the toner guide wall 71 and the bottom side wall 65 that oppose the rubber roller 158 and side seal 41.

As shown in FIGS. 7, 8A and 8B, each sloped part 55 is formed in a pyramidal shape having a bottom wall 56 parallel to the sidewall 141, and a vertex 61. The bottom wall 56 is positioned on the toner guide wall 71 and bottom side wall 65 outside the rubber roller 158 and the side seal 41 in the width direction. The vertex 61 is positioned on the inside edge of the toner receiver 64 in the width direction.

The bottom wall 56 is positioned on the widthwise outer side of the sliding region in which the side seal 41 slidingly contacts the rubber roller 158. The bottom wall 56 is substantially V-shaped when viewed from the outside in the width direction. One end of the V shape is connected to the surface of the toner guide wall 71 opposing the rubber roller 158 and the side seal 41 at a vertical midpoint of the toner guide wall 71. The other end of the V shape is connected to the surface of the side wall 65 opposing the rubber roller 158 and side seal 41 at the upstream end of the side wall 65.

The vertex 61 is the point at which the inside widthwise edges of the toner guide wall 71 and side wall 65 meet.

The sloped part 55 runs continuously from the bottom wall 56 to the vertex 61 (in other words, the sloped part 55 is substantially V-shaped in a side cross section). The surface of the sloped part 55 running from the bottom wall 56 to the vertex 61 and opposing the rubber roller 158 and side seal 41 is a sloped surface 76.

In a vertical cross section, the sloped surface 76 slopes downward from the bottom wall 56 toward the vertex 51 with respect to the width direction. In a plan view, the direction in which the sloped surface 76 slopes is orthogonal to the conveying direction of the conveying belt 168.

Here, the toner receiver 64 may be formed integrally with the casing 50 or may be formed separately from the casing 50.

3. Operations and Effects

As described above with reference to FIG. 5, the side seals 41 are provided on roller-opposing surfaces 54 in the casing 50 of the developer cartridge 32 at positions opposing the outer surface of the rubber roller 158 constituting the developing roller 67 and at the widthwise ends of the rubber roller 158. Therefore, the side seals 41 can prevent toner from leaking between the roller-opposing surfaces 54 and the ends of the rubber roller 158.

However, if by some chance toner leaks between the roller-opposing surfaces 54 and the ends of the rubber roller 158, the leaked toner will fall by its own weight toward the sloped surfaces 76 of the toner receivers 64 positioned directly below the ends of the rubber roller 158 slidingly contacted by the side seals 41, as shown in FIGS. 7, 8A and 8B. Toner that falls onto the sloped surfaces 76 is guided toward the center of the conveying belt 168 in a conveying belt width direction orthogonal to the conveying direction of the conveying belt 168. Specifically, as shown in FIG. 8A, the sloped surfaces 76 slope downward toward the widthwise inner side for guiding toner toward the inner guide opening 73. The toner falls off the inner guide opening 73 in a direction toward the widthwise center region of the conveying belt 168 on the surface that opposes and contacts the photosensitive drums 42 (see FIG. 1).

As shown in FIG. 1, toner that falls onto the surface of the conveying belt 168 in the widthwise center region is conveyed in a counterclockwise direction in FIG. 1 by the conveying belt 168. As described above, the toner is either recovered by the cleaning unit 112 or by the developing roller 67 via the photosensitive drum 42.

If the toner receivers 64 were not provided in this construction, leaked toner would fall by its own weight onto a region of the conveying belt 168 opposing the sliding regions described above and indicated by arrows in FIG. 8B. That is, the leaked toner would fall onto the surface of the conveying belt 168 at positions directly below the regions in which the side seals 41 slidingly contact the rubber roller 158.

When the toner receivers 64 are not provided, toner that falls onto the conveying belt 168 is similarly conveyed in a counterclockwise direction by the conveying belt 168 and is either recovered by the cleaning unit 112 or by the developing rollers 67 via the photosensitive drums 42.

However, leaked toner of one color is recovered by a developing roller 67 carrying toner of a different color in a neighboring drum subunit 46 via regions in which side seals 41 slide against a rubber roller 158, causing entering the side seals 41 to degrade the side seals 41. Consequently, toner of the different color may begin leaking between the roller-opposing surfaces 54 and the ends of the rubber roller 158 in the developer cartridge 32 accommodating toner of the different color. This phenomenon could produce a chain reaction through the conveying belt 168 of leaking toner in all drum subunits 46 until ultimately toner of all colors is leaking.

However, the toner receivers 64 of the preferred embodiment described above drop the initially leaked toner in regions of the conveying belt 168 (widthwise center regions of the conveying belt 168) not corresponding to the regions opposing the sliding regions described above. Hence, even if the leaked toner conveyed on the conveying belt 168 is recovered by the developing roller 67 of a developer cartridge 32 accommodating a different color of toner, the toner is recovered in regions other than the sliding regions in which the side seals 41 slide against the rubber roller 158. Therefore, the leaked toner does not enter the side seals 41, which are designed to prevent the leakage of toner in the other colors, thereby preventing degradation of these side seals 41. Accordingly, this construction can prevent toner of other colors from leaking between the roller-opposing surfaces 54 and the ends of the rubber roller 158 in the developer cartridges 32 accommodating the different colors of toner, thereby reliably preventing a chain reaction of toner leakage in neighboring developer cartridges 32.

As described above, the sloped surface 76 of the toner receiver 64 slopes downward in a direction orthogonal to the conveying direction of the conveying belt 168, that is, the inside in the width direction. Therefore, toner that falls onto the sloped surface 76 drops off the inner guide opening 73 in a direction toward the widthwise center region of the conveying belt 168.

Hence, even if the developing roller 67 of the developer cartridge 32 accommodating toner of a different color recovers the leaked toner conveyed by the conveying belt 168, the toner is recovered in a widthwise center region of the rubber roller 158 separated from the sliding regions in which the side seals 41 slide against the rubber roller 158. As a result, this construction reliably prevents a chain reaction of toner leakage in neighboring developer cartridges 32.

Further, as shown in FIG. 8A, the primary cleaning roller 113 has a portion $\alpha$ that is positioned outside of the inner guide openings 73 into which toner falls in the width direction. Accordingly, the cleaning unit 112 can reliably recover toner that fell on the conveying belt 168.

4. Variations of the Toner Receivers (1) First Variation

Figure 9:
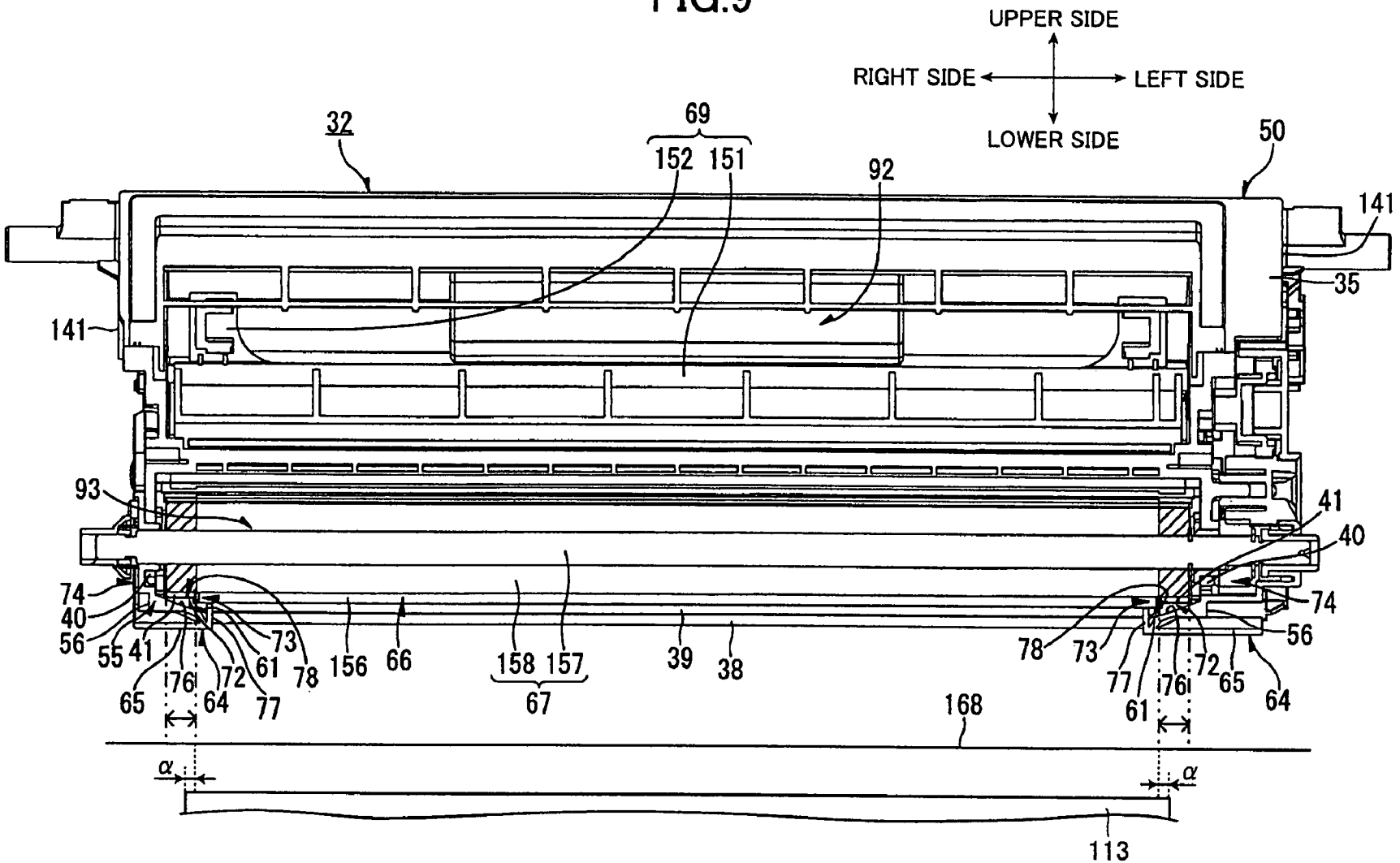
FIG. 9 is a cross-sectional view of the developer cartridge shown in FIG. 8A to which a first variation of at least one aspect of the invention has been applied.

As shown in FIG. 9, the toner receiver 64 of the preferred embodiment described above may include a retaining wall 77 that extends upward from the lower edge of the inner guide opening 73.

By providing the retaining wall 77, a dam portion 78 is formed between the retaining wall 77, the side walls 65, the toner guide wall 71 and the sloped surface 76. Toner that leaks between the roller-opposing surfaces 54 and the ends of the rubber roller 158 and falls in the sloped surface 76 is retained by the retaining wall 77 and accumulated in the dam portion 78, thereby restraining the toner from dropping out of the toner receiver 64 and falling onto the conveying belt 168.

The retaining wall 77 may extend only part way up the toner receiver 64 in the vertical direction so as to form the inner guide opening 73 between the upper edge of the retaining wall 77, the side walls 65, the toner guide wall 71 and the sloped surface 76, rather than filling the entire inner guide opening 73.

With this construction, toner accumulating in the dam portion 78 flows out of the dam portion 78 after exceeding a prescribed amount. However, even when toner flows out of the dam portion 78, the toner falls from the inner guide opening 73 toward the widthwise center region of the conveying belt 168. Accordingly, this construction can delay the time when leaked toner falls onto the surface of the conveying belt 168, and can more reliably prevent a chain reaction of toner leakage in neighboring developer cartridges 32.

Further, as shown in FIG. 9, the primary cleaning roller 113 has a portion $\alpha$ that is positioned outside of the inner guide openings 73 into which toner falls in the width direction. Accordingly, the cleaning unit 112 can reliably recover toner that fell on the conveying belt 168.

(2) Second Variation

As described above, in order to reliably prevent a chain reaction of toner leakage in neighboring developer cartridges 32, it is essential to ensure that leaked toner falls onto the surface of the conveying belt 168 in regions not opposing the sliding, regions at which the side seals 41 slide against the rubber roller 158.

Figure 10:
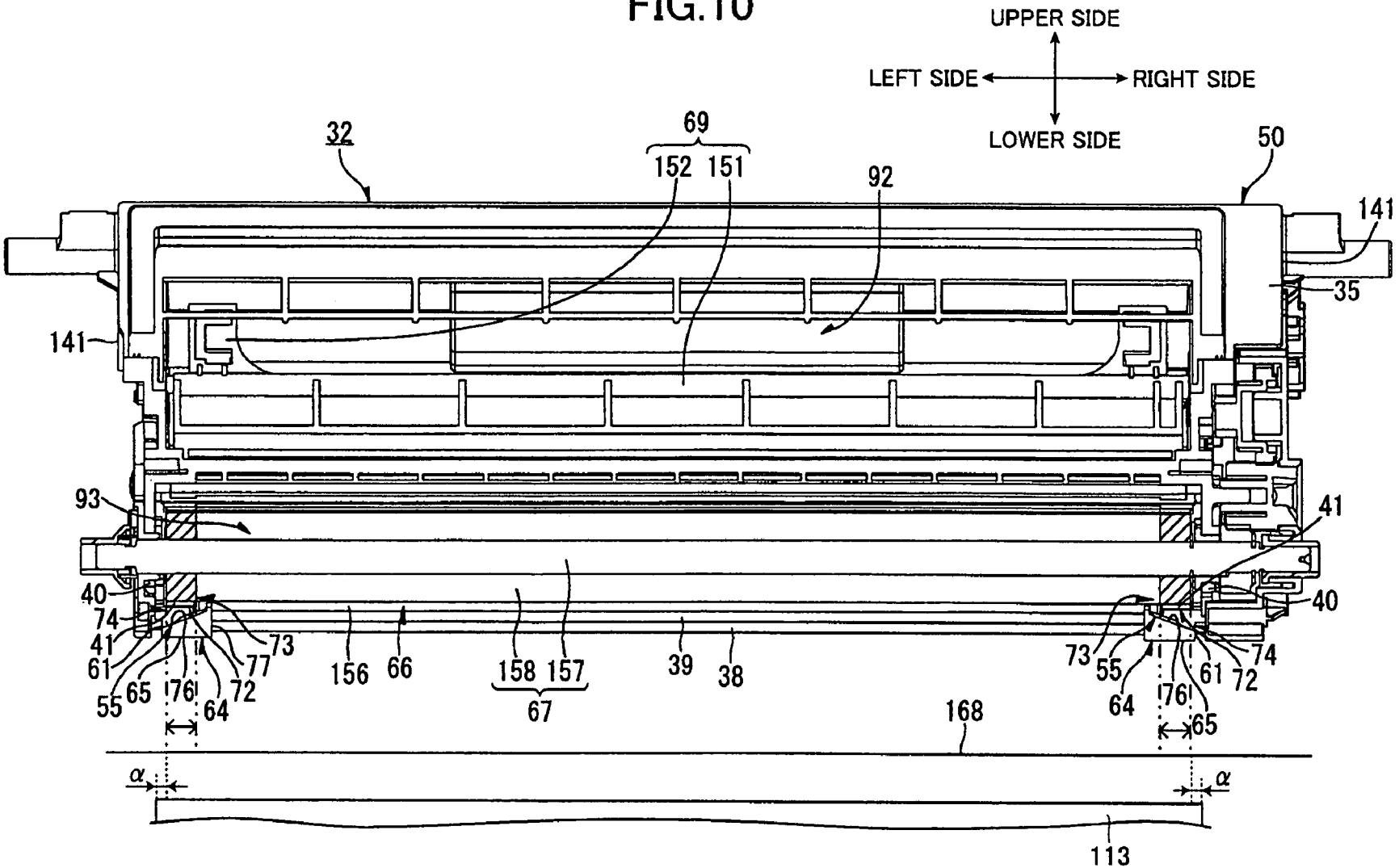
FIG. 10 is a cross-sectional view of the developer cartridge shown in FIG. 8A to which a second variation of at least one aspect of the invention has been applied.

Therefore, while the preferred embodiment described above includes the toner receivers 64 having sloped surfaces 76 that slope downward toward the inside in the width direction, it is also possible to form sloped surfaces 76 that slope downward toward the outer side in the width direction, as shown in FIG. 10.

In this case, toner falling on the sloped surface 76 is guided toward the outer guide opening 74 since the sloped surface 76 slopes downward toward the outside in the width direction. The toner falls from the outer guide opening 74 onto the widthwise ends of the conveying belt 168, that is, the ends in a direction orthogonal to the conveying direction of the conveying belt 168. Hence, even if the developing roller 67 of the developer cartridge 32 accommodating a different color of toner recovers the leaked toner via the photosensitive drum 42 as the leaked toner is conveyed by the conveying belt 168, the toner is recovered at the widthwise ends of the rubber roller 158 separated some distance from the sliding regions in which the side seals 41 slide against the rubber roller 158, thereby achieving the same effects as the preferred embodiment described above.

Further, as shown in FIG. 10, the primary cleaning roller 113 has a portion $\alpha$ that is positioned outside of the outer guide openings 74 into which toner falls in the width direction. Accordingly, the cleaning unit 112 can reliably recover toner that fell on the conveying belt 168.

(3) Third Variation

Figure 11:
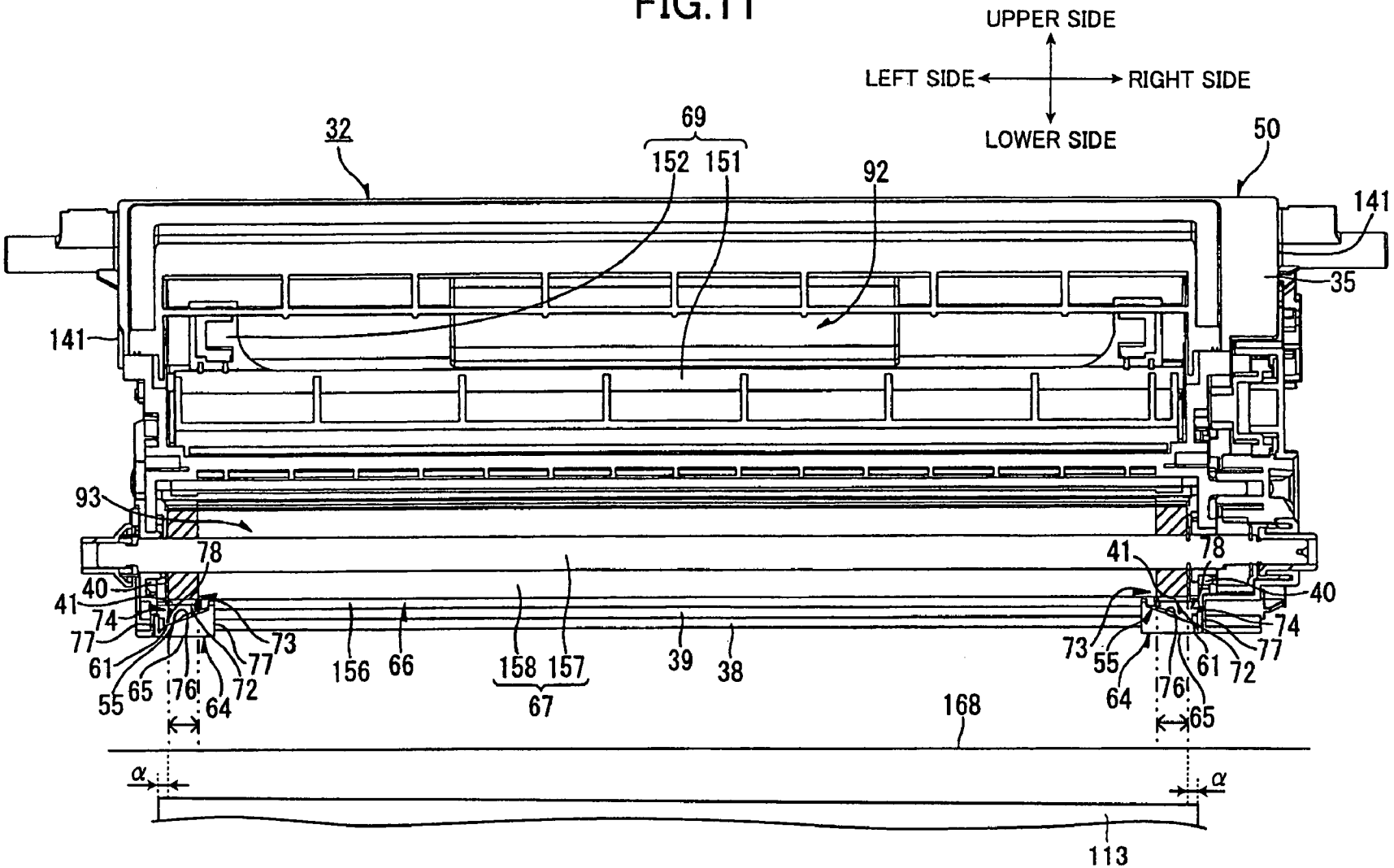
FIG. 11 is a cross-sectional view of the developer cartridge shown in FIG. 10 to which a third variation of at least one aspect of the invention has been applied.

As shown in FIG. 11, the retaining wall 77 described in the first variation may also be provided in the structure described in the second variation. By providing the retaining wall 77 in the second variation to extend upward from the lower edge of the outer guide opening 74 to a vertical midpoint of the toner receiver 64, the same effects described with the retaining wall 77 of the first variation can be obtained.

5. Variations of the Color Laser Printer

In the preferred embodiment described above, the present invention is applied to a tandem color laser printer 1 that directly transfers toner images from the photosensitive drums 42 onto the paper 3. However, the present invention may also be applied to other printers, such as an intermediate transfer type color laser printer that first temporarily transfers toner images in each color from photosensitive members onto an intermediate transfer member and subsequently transfers the entire color image onto paper at once.

While the invention has been described in detail with reference to the specific embodiment thereof, it would be apparent to those skilled in the art that various changes and modifications may be made therein without departing from the spirit of the invention.

What is claimed is:

1. An image-forming device comprising:

a plurality of developer cartridges, each of the developer cartridges including:

a casing configured to accommodate developer therein and having an opening;

a developing roller rotatably provided in the opening, and having a rotational shaft and a peripheral surface, a plurality of rotational shafts of the plurality of developer cartridges being arranged in parallel with one another, the peripheral surface having a first peripheral part to convey the developer accommodated in the casing and a second peripheral part; and a leakage restraining member disposed between the casing and the second peripheral part and configured to slidingly contact the second peripheral part so as to restrain the developer from leaking out of the first peripheral part;

a conveying belt disposed below the plurality of developer cartridges to convey an image formed by developer supplied from the developing roller in a direction orthogonal to the rotational shaft, having a region opposing the leakage restraining member in a vertical direction; and a developer moving member having a receiving surface provided beneath the second peripheral part and sloped with respect to a width direction of the conveying belt to prevent developer leaked from between the second peripheral part and the leakage restraining member from falling into the region.

2. The image-forming device according to claim 1, wherein the second peripheral part is positioned at a longitudinal end of the rotational shaft.

3. The image-forming device according to claim 1, wherein the receiving surface is sloped with respect to the width direction so as to guide developer leaked from between the second peripheral part and the leakage restraining member toward a center of the width of the conveying belt in the width direction.

4. The image-forming device according to claim 3, further comprising a cleaning unit extending in the width direction to clean developer leaving on the conveying belt, wherein the receiving surface has a first end and a second end in the width direction, the first end being disposed near the center of the width of the conveying belt in the width direction than the second end, wherein one end of the cleaning unit is disposed far from the center of the conveying belt in the width direction than the first end.

5. The image-forming device according to claim 3, wherein the receiving surface has a first end and a second end in the width direction, the first end being disposed near the center of the width of the conveying belt in the width direction than the second end, wherein the developer moving member further comprises a wall extending upward from the first end in order to prevent the developer leaked from between the second peripheral part and the leakage restraining member from falling onto the conveying belt.

6. The image-forming device according to claim 5, wherein the wall is formed with a through-hole to allow developer stemmed by the wall to fall onto the conveying belt when amount of the developer stemmed by the wall exceeds a predetermined amount.

7. The image-forming device according to claim 1, wherein the receiving surface is sloped with respect to the width direction so as to guide developer leaked from between the second peripheral part and the leakage restraining member toward a longitudinal end of the rotational shaft in the width direction.

8. The image-forming device according to claim 7, further comprising a cleaning unit extending in the width direction to clean developer leaving on the conveying belt, wherein the receiving surface has a first end and a second end in the width direction, the first end being disposed near the center of the width of the conveying belt in the width direction than the second end, wherein one end of the cleaning unit is disposed far from the center of the conveying belt in the width direction than the second end.

9. The image-forming device according to claim 8, wherein the receiving surface has a first end and a second end in the width direction, the first end being disposed near the longitudinal end of the rotational shaft in the width direction than the second end, wherein the developer moving member further comprises a wall extending upward from the first end in order to prevent the developer leaked from between the second peripheral part and the leakage restraining member from falling onto the conveying belt.

10. The image-forming device according to claim 9, wherein the wall is formed with a through-hole to allow developer stemmed by the wall to fall onto the conveying belt when amount of the developer stemmed by the wall exceeds a predetermined amount.

11. A developer cartridge detachable from an image-forming device including a conveying belt disposed below the developer cartridge to convey an image in a conveying direction when the developer cartridge is mounted on the image-forming device, the developer cartridge comprising:

a casing configured to accommodate developer therein and having an opening;

a developing roller rotatably provided in the opening, and having a rotational shaft and a peripheral surface, the peripheral surface having a first peripheral part to convey the developer accommodated in the casing and a second peripheral part;

a leakage restraining member disposed between the casing and the second peripheral part and configured to slidingly contact the second peripheral part so as to restrain the developer from leaking out of the first peripheral part; and a developer moving member having a receiving surface provided beneath the second peripheral part and sloped with respect to a width direction of the conveying belt to prevent developer leaked from between the second peripheral part and the leakage restraining member from falling onto a region of the conveying belt opposing the leakage restraining member in a vertical direction.

12. The developer cartridge according to claim 11, wherein the second peripheral part is positioned at a longitudinal end of the rotational shaft.

13. The developer cartridge according to claim 11, wherein the receiving surface is sloped with respect to the width direction so as to guide developer leaked from between the second peripheral part and the leakage restraining member toward a center of the width of the conveying belt in the width direction.

14. The developer cartridge according to claim 13, further comprising a cleaning unit extending in the width direction to clean developer leaving on the conveying belt, wherein the receiving surface has a first end and a second end in the width direction, the first end being disposed near the center of the width of the conveying belt in the width direction than the second end, wherein one end of the cleaning unit is disposed far from the center of the conveying belt in the width direction than the first end.

15. The developer cartridge according to claim 13, wherein the receiving surface has a first end and a second end in the width direction, the first end being disposed near the center of the width of the conveying belt in the width direction than the second end, wherein the developer moving member further comprises a wall extending upward from the first end in order to prevent the developer leaked from between the second peripheral part and the leakage restraining member from falling onto the conveying belt.

16. The developer cartridge according to claim 15, wherein the wall is formed with a through-hole to allow developer stemmed by the wall to fall onto the conveying belt when amount of the developer stemmed by the wall exceeds a predetermined amount.

17. The developer cartridge according to claim 11, wherein the receiving surface is sloped with respect to the width direction so as to guide developer leaked from between the second peripheral part and the leakage restraining member toward a longitudinal end of the rotational shaft in the width direction.

18. The developer cartridge according to claim 17, further comprising a cleaning unit extending in the width direction to clean developer leaving on the conveying belt, wherein the receiving surface has a first end and a second end in the width direction, the first end being disposed near the center of the width of the conveying belt in the width direction than the second end, wherein one end of the cleaning unit is disposed far from the center of the conveying belt in the width direction than the second end.

19. The developer cartridge according to claim 18, wherein the receiving surface has a first end and a second end in the width direction, the first end being disposed near the longitudinal end of the rotational shaft in the width direction than the second end, wherein the developer moving member further comprises a wall extending upward from the first end in order to prevent the developer leaked from between the second peripheral part and the leakage restraining member from falling onto the conveying belt.

20. The developer cartridge according to claim 19, wherein the wall is formed with a through-hole to allow developer stemmed by the wall to fall onto the conveying belt when amount of the developer stemmed by the wall exceeds a predetermined amount.

* * * * *